US005460931A

United States Patent [19]

Tanaka et al.

[11] Patent Number: 5,460,931

[45] Date of Patent: Oct. 24, 1995

[54] LIGHT-SENSITIVE SILVER HALIDE COLOR PHOTOGRAPHIC MATERIAL

[75] Inventors: Shigeo Tanaka; Tsuyoshi Ikeda, both of Hino, Japan

[73] Assignee: Konica Corporation, Japan

[21] Appl. No.: 337,749

[22] Filed: Nov. 14, 1994

[30] Foreign Application Priority Data

Nov. 16, 1993 [JP] Japan ..... 5-286984

[51] Int. Cl.[6] ..... G03C 1/775

[52] U.S. Cl. ..... 430/538; 430/523; 430/950; 430/496; 430/531; 430/539; 430/536; 430/510

[58] Field of Search ..... 430/538, 523, 430/950, 496, 531, 539, 536, 510

[56] References Cited

U.S. PATENT DOCUMENTS

| | | | |
|---|---|---|---|
| 4,536,472 | 8/1985 | Kato et al. | 430/505 |
| 4,558,002 | 12/1985 | Aotsuka et al. | 430/538 |
| 4,563,406 | 1/1986 | Ohbayashi et al. | 430/513 |
| 4,755,454 | 7/1988 | Aotsuka et al. | 430/538 |
| 4,921,781 | 5/1990 | Takamuki et al. | 430/496 |
| 5,075,196 | 12/1991 | Daems et al. | 430/538 |
| 5,234,804 | 8/1993 | Sato et al. | 430/538 |
| 5,242,786 | 9/1993 | Tanaka et al. | 430/523 |
| 5,252,424 | 10/1993 | Sato et al. | 430/138 |

FOREIGN PATENT DOCUMENTS 0246642 9/1992 Japan .

OTHER PUBLICATIONS

Research Disclosure, Item 16386, "Textured Photographic Resin Coated Papers", Muka et al, Nov. 1977.

*Primary Examiner*—Thomas R. Neville
*Attorney, Agent, or Firm*—Jordan B. Bierman; Bierman and Muserlian

[57] ABSTRACT

A light-sensitive silver halide photographic material is disclosed, comprising a reflective support comprising a resin layer-coated base paper and having thereon a silver halide emulsion layer , wherein a hydrophilic colloid layer containing a white pigment is provided between the resin layer and the silver halide emulsion layer; the resin layer having an uneven surface; and a Wiener spectrum of the silver halide photographic material satisfying the following relation, $$1.1<(WS2) / (WS1)<2.0$$

wherein WS1 and WS2 are average intensities of the spectrum within a spatial frequency range of 2 to 3 $mm^{-1}$ and 10 to 20 $mm^{-1}$, respectively.

7 Claims, No Drawings

LIGHT-SENSITIVE SILVER HALIDE COLOR PHOTOGRAPHIC MATERIAL

FIELD OF THE INVENTION

This invention relates to a light-sensitive silver halide photographic material that can obtain a photographic print having a moderate glossiness and having superior detail representation and visual sharpness of images.

BACKGROUND OF THE INVENTION

Because of a high sensitivity, superior gradation, sharpness, graininess and color reproduction and a suitability for high-volume finishing operation, light-sensitive silver halide photographic materials are nowadays very widely used. When people take trips or join a variety of events, not only snapshots are taken by individuals but also various group portraits are taken, and kept in commemoration. Also, photographs have begun to be used for decoration of coin-operated lockers of railroad stations or shutters of stores. In other instances, photographs are stuck to name cards, and also postcards to which photographs have been stuck are nowadays used in New Year's cards or the like. Under such circumstances where photographs are increasingly used in a very variety of places in life, photographs have been sought to be easy and simple to handle, and also to have images with a much higher quality, in particular, to have visually sharp images.

In what is called photographic prints, baryta paper or paper supports coated with a polyolefin such as polyethylene have been hitherto in wide use. In particular, polyolefin-coated paper supports have been used in large number since processing chemicals do not soak into the supports to therefore enable rapid processing and drying.

Polyolefin-coated paper supports are coated with a polyolefin resin on both sides of the paper, and a white pigment such as titanium oxide is contained therein on the side on which silver halide photographic emulsion layers are provided, and it forms a reflective layer. Because of a difficulty in uniformly dispersing white pigments such as titanium oxide in polyolefins, a limit must be set to the amount of the white pigment to be dispersed in the polyolefin. As a result, with regard to the light reflected on the surface of a polyolefin layer, the diffusion of light in the polyolefin layer or the diffusion of light in the base paper beneath it has become non-negligible, so that there is a disadvantage that the sharpness can not be well improved.

Japanese Patent Publication Open to Public Inspection (hereinafter referred to as Japanese Patent O.P.I. Publication) No. 69630/1978 discloses a technique in which a specific compound is incorporated into a white pigment layer of, e.g., a light-sensitive silver halide photographic material for areal photogrammetry so that the whiteness of white backgrounds can be improved in the course of processing and thereafter. Japanese Patent O.P.I. Publication No. 64265/1982 discloses a technique in which a white pigment and a dye are provided onto a polyolefin-coated paper support so that the sharpness can be improved. Japanese Patent O.P.I. Publication No. 60738/1983 discloses that images with superior sensitivity and sharpness can be obtained when a colorant-containing layer capable of being decolored upon processing, a white pigment-containing layer and a silver halide emulsion layer are provided on a support in this order. Japanese Patent O.P.I. Publication No. 177542/1984 discloses a technique for improving sharpness and sensitivity using a light-sensitive material comprising a support comprised of a substrate covered with a synthetic resin film and provided on one side thereof a hydrophilic colloid layer having a white pigment in a specific content and a silver halide photographic emulsion layer. U.S. Pat. No. 5,252,424 discloses a technique for achieving a high sensitivity and a superior sharpness using a light-sensitive silver halide photographic material comprising a polyolefin-coated paper support and provided on at least one side thereof i) a hydrophilic colloid layer containing a removable halation-preventive substance, 20 to 80% by weight of a white pigment and 5 to 35% by weight of hollow fine spheres of 0.1 to 1 μm diameter and ii) a silver halide emulsion layer. Employment of these techniques can bring about an improvement in physical sharpness, but there has been the problems that it brings about only a small improvement in visual sharpness. In the case of supports having a very good smoothness, this difference can be small, but in the case of supports having resin coat layers on both sides this difference are not ignorable.

As for a reflective support provided with a resin coat layer, various patterns can be formed on its surface by using a cooling roll engraved with various patterns, after molten polyethylene has been applied to the surface of paper and while the coating is cooled to solidify. A typical example thereof is the "silk finish" on which patterns having a given form are arranged in regular order (hereinafter, the type of such embossing is called "texture").

Japanese Patent Examined Publication No. 53941/1982 discloses a polyolefin-coated paper for photography which is characterized by having a pebble-grained surface configuration wherein 20 to 35 cancavities-and-convexies (hills-and-dales) with a peak-to-valley distance of 5 to 20 μm are present at an interval of 3 mm, and it is stated that such a surface configuration can achieve a preferable surface glossiness. It also discloses that the glossiness can be kept in the desired range with difficulty if the peak-to-valley distance is less than 5 μm and images may become unsharp and undesirable if it is more than 20 μm, and also that the glossiness may become too high if the number of the hills-and-dales with a peak-to-valley distance of about 5 to 20 μm is less than 20 and the mattness may become too strong and undesirable if it is more than 35. Japanese Patent O.P.I. Publication No. 280142/1990 discloses that a light-sensitive color photographic material comprising a support having 4 to 20 per mm of periodical hills-and-dales on its surface makes any uneven color and uneven density inconspicuous when precessed so as to produce uniform colors. This publication, however, neither mentions nor suggests that the periodical distribution of hills and dales may greatly affect the visual image quality.

Japanese Patent O.P.I. Publication No. 166833/1992 discloses that a silver halide photographic emulsion layer having a good matt gloss and free of coating mottles can be obtained using a photographic resin-coated paper support comprising a substrate coated with a resin on its both sides, having an SRa (surface roughness) of 0.3 to 3.0 μm and in which the power spectrum of a spatial frequency of 1 to 100 $^{-1}$ mm has a height of not more than 1.2 times the height of a variable peak in frequency components adjacent each other. This technical publication, however, is only discloses the conditions under which no coating mottles may occur, determined on the basis of the relationship between the frequency distribution of surface irregularities of a base paper and the occurrence of coating mottles, and neither mentions nor suggests the relationship between the frequency distribution of surface irregularities of a base paper and the image quality, that is questioned when the hydrophilic colloid layer containing a white pigment is provided between a resin coat layer and a silver halide photographic emulsion layer.

The present inventors have disclosed in Japanese Patent O.P.I. Publication No. 246642/1992 that a light-sensitive silver halide photographic material comprising a reflective support in which Wiener spectrum has at least two peaks in the region of a spatial frequency of from 2 to 20 $mm^{-1}$ and satisfying a specific relation between a maximum intensity and a second peak, makes it possible to achieve a moderate glossiness and a superior detail representation. They, however, have neither mention nor suggest the problem caused when the hydrophilic colloid layer containing a white pigment is provided between a resin coat layer and a silver halide photographic emulsion layer.

SUMMARY OF THE INVENTION

An object of the present invention is to provide a light-sensitive silver halide photographic material that can obtain a photographic print having a moderate glossiness and having superior detail representation and visual sharpness of images.

The present inventors have made extensive studies on how to make image quality higher in light-sensitive silver halide photographic materials comprising a reflective support comprised of a base paper provided on its each side with a resin coat layer, and in the course of the study they have discovered that the above object of the present invention can be achieved by a light-sensitive silver halide photographic material comprising i) a reflective support comprised of a base paper provided on its each side with a resin coat layer and ii) at least one silver halide photographic emulsion layer formed thereon, wherein;

at least one hydrophilic colloid layer containing a white pigment is provided between the resin coat layer and the silver halide photographic emulsion layer, the resin coat layer provided on the side having the emulsion layer has a hill-and-dale irregular surface (i.e., uneven surface), and the Wiener spectrum (hereinafter "WS") of the light-sensitive silver halide photographic material satisfies the relation of $$1.1 < (WS2) / (WS1) < 2.0$$

between WS1: an average intensity at a spatial frequency of 2 to 3 $mm^{-1}$ and WS2: an average intensity at a spatial frequency of 10 to 20 $mm^{-1}$. Thus, they have accomplished the present invention.

DETAILED DESCRIPTION OF THE INVENTION

The reflective support used in the present invention is characterized by a paper support comprised of a base paper having resin coat layers on both sides thereof. As a synthetic resin with which the both sides of the base paper are coated, any known compounds may be used, including polyethylene, polypropylene, vinyl chloride and polyethylene terephthalate. In particular, a support having polyethylene resin layers on its surfaces is preferred.

The resin coat layer may preferably contain a white pigment, in the form of finely divided particles, in the inside of the layer. As the white pigment contained in the resin coat layer, inorganic and/or organic white pigments may be used, and inorganic white pigments are preferably used. Such pigments may include, for example, alkaline earth metal sulfates such as barium sulfate, alkaline earth metal carbonates such as calcium carbonate, silicates (silica) such as finely divided silicate and synthetic silicates, and also calcium silicate, alumina, alumina hydrates, titanium oxide, zinc oxide, talc and clay. The white pigment may preferably be barium sulfate or titanium oxide.

The white pigment contained in the resin coat layer provided on the surface of the reflective support may preferably be in an amount of not less than 10% by weight, more preferably not less than 13% by weight, and still more preferably not less than 15% by weight, as content in the resin coat layers. The dispersity (mono-dispersity) of the white pigment particles in the resin coat layer of the paper support used in the present invention can be measured by the method disclosed in Japanese Patent O.P.I. Publication No. 28640/1990. As measured by this method, the white pigment may preferably be in a dispersion of not more than 0.20, more preferably not more than 0.15, and still more preferably not more than 0.10, as the coefficient of variation disclosed in that publication.

The depth of valleys in the irregular (uneven) surface of the reflective support used in the present invention should be determined so as to satisfy the definition for the intensity of WS described above. Stated approximately, the hills and dales in the irregular surface may preferably have a peak-to-valley distance of from 0.1 to 30 μm on the average, and more preferably from 0.3 to 15 μm.

The hills in the irregular surface of the reflective support used in the present invention may have any form, including regular forms such as rounds, elipses, triangles, squares, rectangles, parallelograms, diamonds, pentagons, hexagons and so forth, as well as composite forms in which, e.g., round concavities are further formed in any of these forms, and also including entirely amorphous patterns.

The WS is an amount chiefly used to evaluate graininess in the evaluation of photographic images. Its general description is available from T. H. James ed., "The Theory of the Photographic Process" 4th Ed., p.595, Macmillan Publishing Co., New York (1977).

To measure the WS, the density of a light-sensitive silver halide photographic material to be measured may be measured, with respect to the side having a silver halide emulsion layer, by means of, e.g., KONICA MICRODENSITOMETER PDM5-TYPE, and calculation may be made according to the method described in J. C. Dainty and R. Shaw, "Image Science", Chapter 8, Academic Press, New York (1974). The WS should be measured usually using an aperture of 10μm×400 μm. In the case when the hills formed in the irregular surface of the support have a very smaller form than the aperture, it is preferable to use an aperture having a smaller size than that.

The patterns having such a frequency distribution can be formed by any known methods. For example, as previously mentioned, a pattern having the desired frequency distribution may be beforehand formed on a roller used when a molten polyolefin resin is laminated to the surface of a paper support and then the coating is cooled to solidify.

The light-sensitive silver halide photographic material according to the present invention is characterized in that the ratio of WS average intensity WS1 at a spatial frequency of 2 to 3 $mm^{-1}$ to the average intensity WS2 at a spatial frequency of 10 to 20 $mm^{-1}$ satisfies the relation of $$1.1 < (WS2) / (WS1) < 2.0.$$

If this ratio is smaller than the stated value, the effect of the present invention can not be obtained. If it is larger than this value, the detail representation may be damaged to cause an unnatural representation in the skin rendering of a portrait.

It is more preferable to satisfy the relation of $$1.2 < (WS2) / (WS1) < 1.7.$$

The average intensity of WS herein used refers to an average of the values represented on a plane by plotting the common logarisms of WS intensity as ordinate and the common logarisms of spatial frequency as abscissa. In other words, the average intensities WS1 and WS2 are defined as follows: T,130 where f(x) is a log WS intensity at log spatial frequency x.

In the above plane formed by plotting the common logarisms of WS intensity and the common logarisms of spatial frequency, an average gradient in the region of a spatial frequency of 2 to 3 $mm^{-1}$ also has an influence on the naturalness of detail representation, and hence its value may preferably be in the range of from 0.8 to 2.2. The word "average gradient" means a slope of a straight line connecting the intensities on the log intensity-log spatial frequency curve which corresponding respectively to spatial frequencies of 2 and 3 $mm^{-1}$. Thus, the average gradient is T,140 where $I_2$ and $I_3$ represent log intensities at spatial frequencies of 2 and 3 $mm^{-1}$, respectively.

The light-sensitive silver halide photographic material according to the present invention is characterized in that the hydrophilic colloid layer provided between the silver halide photographic emulsion layer and the resin layer that covers the base paper contains a white pigment. As the white pigment, it is possible to use, e.g., futile type titanium dioxide, anatase type titanium dioxide, barium sulfate, barium stearate, silica, alumina, zirconium oxide and kaolin. In particular, it is preferred to use titanium dioxides. The white pigment is dispersed in a hydrophilic colloid into which aqueous processing solutions can permeate, as exemplified by gelatin, and the resulting dispersion is coated to form a hydrophilic colloid layer. The white pigment may preferably be in a coating weight usually ranging from 1 to 50 g, and more preferably from 1 to 20 g, per 1 $m^2$.

Besides the white pigment, colorants such as yellow, gray, blue or black colloidal silver, inorganic color pigments, organic color pigments, and dyes may be added to the hydrophilic colloid layer. As the colorants, besides the yellow, gray, blue or black colloidal silver, various known filter dyes may be used. The filter dyes may be either those capable of absorbing the light of the visible spectral range as a whole or those capable of absorbing it in part. In instances in which infrared-sensitive emulsions are contained, compounds capable of absorbing infrared rays may preferably be contained. As the dyes having absorption in the visible region, the dyes disclosed as AI-1 to AI-11 in Japanese Patent O.P.I. Publication No. 251840/1991, page 308. As the infrared absorptive dyes, the compounds represented by Formulas (I), (II) and (III), disclosed in Japanese Patent O.P.I. Publication No. 280750/1989, page 2, left lower column, are preferred since they have preferable spectral characteristics, do not affect the photograph performance of silver halide photographic emulsions and also may cause no stain due to residual color. Examples of preferred compounds may include exemplary compounds (1) to (45) disclosed in the same publication, page 3, left lower column to page 5, left lower column.

The hydrophilic colloid layer may also contain hollow fine particles such as microcapsules holding air in their insides. As materials for forming such microcapsules, it is possible to use polyvinyl chloride, polystyrene, polyvinyl acetate, a vinyl chloride-vinylidene chloride copolymer, cellulose acetate, ethyl cellulose, novolak resin, polymethyl methacrylate and polyacrylamide. A styrene-acrylic acid copolymer is preferred. When such microcapsules are contained, sharpness can be improved and also detail representation at highlight portions can be made higher.

A non-sensitive hydrophilic colloid layer such as an under coat layer, an intermediate layer or a colorant-containing filter layer may also be provided between the hydrophilic colloid layer described above and the resin layer that covers the base paper. As the colorant that can be used in the colorant-containing filter layer may include the compounds preferably usable in the hydrophilic colloid layer containing the white pigment as described above. The colorant-containing filter layer may preferably have a light transmittance of not more than 50%, and mope preferably not more than 30%.

The silver halide photographic emulsion preferably used in the present invention may include silver halide emulsions containing 95 mol% or more of silver chloride. So long as they contain it within the range satisfying such a condition, they may have any halogen composition such as silver chloride, silver chlorobromide and silver chloroiodobromide. Silver chlorobromide containing substantially no silver iodide is preferred. Silver chlorobromide containing not less than 97 mol%, and preferably 98 to 99.9 mol%, of silver chloride is more preferred. Silver bromide emulsions locally containing a silver bromide phase in a high concentration may also preferably be used.

The silver halide photographic emulsion used in the present invention may contain various types of heavy metal compound. Such a compound can be advantageously used especially when image forming methods making use of a laser is employed. The heavy metal compound that can be used for such purpose may preferably be added in an amount of from not less than $1\times10^{-9}$ mol to not more than $1\times 10^{-2}$ mol, and more preferably from not less than $1\times10^{-8}$ mol to not more than $1\times10^{-5}$ mol, per mol of silver halide. The compound that can be preferably used may include the following: T,180

To incorporate any of these heavy metal compounds into silver halide grains, the heavy metal compound may be added at any desired position before the formation of silver halide grains, in the course of the formation of silver halide grains, or in the course of physical ripening after the formation of silver halide grains.

The silver halide grains according to the present invention may have any form. A preferable example is a cube having (100) plane as a crystal surface. Grains having the form of octahedrons, tetradecahedrons, dodecahedrons or the like may be prepared by the method disclosed in U.S. Pat. Nos. 4,183,756 and No. 4,225,666, Japanese Patent O.P.I. Publication No. 26589/1980, Japanese Patent Examined Publication No. 42737/1980 or The Journal of The Photographic Science (J. Photogr. Sci.) 21, 39 (1973), and such grains may be used. Grains having twin planes may also be used.

There are no particular limitations on the grain size of the silver halide grain according to the present invention. Taking account of rapid processability, sensitivity and other photographic performances, the grain size may preferably be in the range of from 0.1 to 1.2 μm, and more preferably from 0.2 to 1.0 μm. The grain size can be measured by various methods commonly used in the present technical field. A typical method include the method disclosed in Loveland, Particle-Size Analytical Method, ASTM Symposium on Light Microscopy, pages 94–122, 1955, or Mees and James, The Theory of The Photographic Process, Third Edition, Chapter 2, Macmillan Publishing Co., Inc., 1966.

This grain size can be measured using projected areas of grains or approximate values of diameters. In the case when the grains are substantially uniform in their shapes, grain size distribution can be reasonably accurately expressed as diameters or projected areas.

The distribution of grain size of the silver halide grains according to the present invention may be either polydisperse or monodisperse. Preferred are monodisperse silver halide grains having a coefficient of variation of 0.22 or less, and more preferred are those of 0.15 or less. Here, the coefficient of variation is a coefficient that represents the breadth of grain size distribution, and is defined by the following expression.

Coefficient of variation= S/R wherein S represents a standard deviation of grain size distribution, and R represents an average grain size.

The grain size herein referred to indicates a diameter of a grain when it is a spherical silver halide grain or, when it is a grain having the shape other than that of a cube or sphere, a diameter obtained by calculating its projected image into a circular image having the same area.

The silver halide emulsion can be prepared using various apparatus and methods known in the present industrial field.

The silver halide emulsion used in the present invention may be obtained by any of the acidic method, the neutral method and the ammoniacal method. The grains may be grown at one time, or may be grown after seed grains have been produced. The manner by which the seed grains are produced and the manner by which grains are grown may be the same or different.

The mode in which a soluble silver salt and a soluble halide salt are allowed to react may be any of normal precipitation, reverse precipitation, double-jet precipitation, and combinations of these. Emulsions obtained by double-jet precipitation are preferred. As a mode of the double-jet precipitation, the pAg-controlled double-jet precipitation as disclosed in Japanese Patent O.P.I. Publication No. 48521/1979 may also be used.

It is also possible to use an apparatus for feeding an aqueous solution of a water-soluble silver salt and an aqueous solution of a water-soluble halide salt from an addition apparatus provided in reaction mother liquor, as disclosed in Japanese Patent O.P.I. Publications No. 92523/1982 and No. 92524/1982; an apparatus for adding aqueous solutions of a water-soluble silver salt and a water-soluble halide salt while continuously changing their concentrations, as disclosed in German Patent Publication No. 29 21 164; and an apparatus for forming grains while keeping the distance between silver halide grains constant, by taking out mother liquor outside a reaction vessel and concentrating it by ultrafiltration, as disclosed in Japanese Patent Examined Publication No. 501776/1981.

If necessary, a silver halide solvent such as thioether may also be used. Also, a compound having a mercapto group, a nitrogen-containing heterocyclic compound or a compound such as a spectral sensitizer may be used by adding them when silver halide grain are formed or after the formation of grains has been completed.

The silver halide emulsion used in the present invention may be subjected to sensitization making use of a gold compound, sensitization making use of a calcogen sensitizer or reduction sensitization, which may be used alone or in combination. Silver halide emulsions having been subjected to gold sensitization can make the present invention greatly effective, and are preferred.

Sulfur sensitizers applied in the silver halide emulsion used in the present invention may include allylthiocarbamidothiourea, allylisocyanate, cystine, p-toluenethiosulfonate, rhodanine, triethylthiourea and inorganic sulfur. The amount of the sulfur sensitizer added when the silver halide emulsion used in the present invention is subjected to chemical sensitizerion may preferably be changed depending on silver halide emulsions used, and may be in the range of from $5\times10^{-10}$ to $5\times10^{-5}$ mol, and preferably from $5\times10^{-8}$ to $5\times10^{-5}$ mol, per mol of silver halide.

As gold sensitizers used when the silver halide emulsion used in the present invention is subjected to chemical sensitization, they may be added in the form of various gold complexes such as chloroauric acid and gold sulfide. A ligand of the gold complex used may include dimethyl rhodenine, thiocyanic acid, mercaptotetrazole and mercaptotriazole. Specific compounds of the gold complex may include exemplary compounds I-6, I-18, I-19, I-21, IV- 1 and V-1 disclosed in Japanese Patent O.P.I. Publication No. 113517/1993, pages 118–123. The amount of the gold compound used can not be uniform depending on the type of the silver halide emulsion, the type of the compound used and the ripening conditions. In usual instances, it may preferably be in the range of from $1\times10^{-4}$ mol to $1\times10^{-8}$ mol per mol of silver halide. It may more preferably be in the range of from $1\times10^{-5}$ mol to $1\times10^{-8}$ mol.

Sensitizers used in selenium sensitization of the silver halide photographic emulsion used in the present invention may include wide range of selenium compounds. For example, they may include the compounds disclosed in U.S. Pat. Nos. 1,574,944, No. 1,602,592 and No. 1,623,499, Japanese Patent O.P.I. Publications No. 150046/1985, No. 25832/1992, No. 109240/1992 and No. 147250/1992.

Useful selenium sensitizers may include colloidal selenium metals, isoselenocyanates as exemplified by allylisoselenocyanate, selenoureas as exemplified by N,N-dimethylselenourea, N,N-N'-triethylselenourea, N,N,N'-trimethyl-N'-heptafluoroselenourea, N,N,N'-trimethyl-N'-heptafluoropropylcarbonylselenourea and N,N,N'-trimethyl-N'-(4-nitrophenyl)carbonylselenourea, selenoketones as exemplified by selenoacetone and selenoacetophenone, selenoamides as exemplified by selenoamide, N,N-dimethylselenobenzamide, selenocarboxylic acids and selenoesters as exemplified by 2-selenopropionic acid and methyl-3-selenobutylate, selenophosphates as exemplified by tri-p-triselenophosphate, and selenides as exemplified by diethyl selenide and diethyl diselenide. In particular, preferred selenium sensitizers are selenoureas, selenoamides and selenoketones.

Tellurium sensitizers and sensitization methods used in the silver halide photographic emulsion used in the present invention are disclosed in U.S. Pat. Nos. 1,623,499, No. 3,320,069, No. 3,772,031, No. 3,531,289 and No. 3,655,394, British Patents No. 1,121,496, No. 1,295,462 and No. 1,396,696, Canadian Patent No. 800,958 and Japanese Patent O.P.I. Publication No. 204540/1992. Examples of useful tellurium sensitizers are telluroureas and telluroamides.

The silver halide emulsion used in the present invention may be subjected to the reduction sensitization by using known methods. For example, it is possible to use a method in which various reducing agents are added, a method in which ripening is carried out under conditions of a high silver ion concentration, or a method in which ripening is carried out under conditions of a high pH.

The reducing agent used in the reduction sensitization of the silver halide emulsion used in the present invention may include stannous salts such as stannous chloride, boranes such as tri-t-butylamineborane, sulfites such as sodium sulfite and potassium sulfite, reductones such as ascotbit acid, and thiourea dioxide. Of these, compounds preferably usable may include thiourea dioxide, ascotbit acid and derivatives thereof, and sulfites. Compared with the case when reduction sensitization is carried out while controlling silver ion concentration and pH during the ripening, the method making use of a reducing agent as described above has a superior reproducibility and hence is preferred.

An oxidizing agent may be used in a small amount so that reduction-sensitizing nuclei can be modified after the reduction sensitization or any remaining reducing agent can be deactivated. Compounds used for such purpose may include potassium ferric hexacyanate, bromosuccinimide, p-quinone, potassium perchlorate and hydrogen peroxide.

In the silver halide emulsion according to the present invention, known antifoggants and stabilizers may be used for the purposes of preventing fog from occurring in the course of the preparation of the light-sensitive silver halide photographic material, decreasing variations in performances during storage and preventing fog from occurring at the time of development. Compounds that can be used for such purpose can be exemplified by compounds represented by Formula II disclosed in Japanese Patent O.P.I. Publication No. 146036/1990, page 7, lower column. Specific compounds thereof may include compounds IIa-1 to IIa-8 and IIb-1 to IIb-7 disclosed in the same publication, page 8, and compounds such as 1-(3-methoxyphenyl)- 5-mercaptotetrazole and 1-(4-ethoxyphenyl)- 5-mercaptotetrazole. Depending on the purpose, these compounds may be added in the step of preparing silver halide emulsion grains, in the step of chemical sensitization, at the time when the step of chemical sensitization is completed, or in the step of preparing coating solutions. In the case when chemical sensitization is carried out in the presence of such a compound, the compound may preferably be used in an amount of about $1\times10^{-5}$ mol to about $5\times10^{-4}$ mol per mol of silver halide. In the case when the compound is added at the time when chemical sensitization is completed, it may preferably be in an amount of from about $1\times10^{-6}$ mol to about $1\times10^{-2}$ mol, and more preferably from $1\times10^{-5}$ mol to $5\times10^{-3}$ mol, per mol of silver halide. In the case when the compound is added to silver halide emulsion layers in the step of preparing coating solutions, it may preferably be in an amount of from about $1\times10^{-6}$ mol to about $1\times10^{-1}$ mol, and more preferably from $1\times10^{-5}$ mol to $1\times10^{-2}$ mol, per mol of silver halide. In the case when the compound is added to layers other than the silver halide emulsion layers, it may preferably be in an amount of from about $1\times10^{-9}$ mol to about $1\times10^{-3}$ mol as its amount in a coating layer.

In the light-sensitive silver halide photographic material according to the present invention, dyes having absorption in various wavelength regions may be used for the purpose of anti-irradiation. For this purpose, any known compounds may be used. In particular, the compounds exemplified as the compound preferably usable in the hydrophilic colloid layer containing the white pigment as previously described are preferred. Any of these compounds may be used in a suitable amount in accordance with the relationship between it and the desired sharpness or sensitivity. For example, stated in relation to red-sensitive emulsion layers having the poorest sharpness under the existing conditions, the compound may preferably be used in such an amount that the spectral reflection density at a wavelength of 680 nm is 0.70 or more.

The light-sensitive silver halide photographic material according to the present invention may be a light-sensitive black and white photographic material making use of metallic silver to form images, or may be a light-sensitive black and white photographic material making use of a black dye or a black dye image produced by balancing yellow, magenta and cyan dyes, or still may be a light-sensitive color photographic material making use of yellow, magenta and cyan dyes. The present invention is particularly useful in the case of light-sensitive color photographic materials.

In the case when the light-sensitive silver halide photographic material according to the present invention is used as a light-sensitive color photographic material, it has layers containing silver halide emulsions spectrally sensitized to specific regions of wavelength regions of from 400 to 900 nm in combination of a yellow coupler, a magenta coupler and a cyan coupler. Such silver halide emulsions contain one kind or two or mope kinds of spectral sensitizers in combination.

With regard to the spectral sensitizing dyes used in the silver halide emulsion according to the present invention, any known compounds can be preferably used. As blue-sensitive spectral sensitizing dyes, BS-1 to BS-8 disclosed in Japanese Patent O.P.I. Publication No. 251840/1991, page 28, may preferably be used alone or in combination. As green-sensitive spectral sensitizing dyes, GS-1 to GS-5 disclosed in the same application, page 28, may preferably be used. As red-sensitive spectral sensitizing dyes, RS-1 to RS-8 disclosed in the same application, page 29, may preferably be used. In instances in which the light-sensitive material is exposed using a printer making use of a semiconductor laser, a spectral sensitizing dye having a sensitivity to infrared must be used. As infrared-sensitive spectral sensitizing dyes, the dyes IRS-1 to IRS-11 disclosed in Japanese Patent O.P.I. Publication No. 285950/1992, pages 6–8, may preferably be used. It is also preferable to use supersensitizers SS-1 to SS-9 disclosed in the same application, pages 8-9, in combination with these dyes.

Any of these spectral sensitizing dyes may be added at any time after the formation of silver halide grains up to the time when chemical sensitization is completed.

The spectral sensitizing dye may be added in the form of a solution prepared by dissolving it in a water-miscible organic solvent such as methanol, ethanol, fluorinated alcohol, acetone or dimethylformamide, or in the form of a solid dispersion.

The solid dispersion of a spectral sensitizing dye can be obtained by a method in which the dye is mechanically pulverized and dispersed into fine particles of 1 μm or less diameter in an aqueous medium using a high-speed stirrer. Besides, it can also be obtained by a method in which the dye is mechanically pulverized and dispersed into fine particles of 1 μm or less diameter in an aqueous medium under conditions of pH 6 to 8 and 60 to 80° C., as disclosed in Japanese Patent O.P.I. Publication No. 105141/1983, or a method in which the dye is dispersed in the presence of a surface active agent capable of controlling the surface tension to be 38 dyne/cm or lower, as disclosed in Japanese Patent Examined Publication No. 6496/1985.

Dispersion machines usable for preparing dispersions can be exemplified by the high-speed stirrer disclosed in Japanese Patent O.P.I. Publication No. 125631/1992, FIG. 1, as well as a ball mill, a sand mill and an ultrasonic dispersion machine.

In use of any of these dispersion machines, as disclosed in Japanese Patent O.P.I. Publication No. 125632/1992, a pretreatment such as dry pulverization may be previously applied and thereafter wet dispersion may be carried out. Such a method may be employed.

As couplers used in the light-sensitive silver halide photographic material according to the present invention, any compounds can be used so long as they are capable of coupling with an oxidized product of a color developing agent to form coupling products having a spectral absorption maximum wavelength in a wavelength region longer than 340 nm. In particular, typical compounds are those known as yellow couplers having a spectral absorption maximum wavelength in a wavelength region of from 350 to 500 nm, magenta couplers having a spectral absorption maximum wavelength in a wavelength region of from 500 to 600 nm, and cyan couplers having a spectral absorption maximum wavelength in a wavelength region of from 600 to 750 nm.

Cyan couplers preferably usable in the light-sensitive silver halide photographic material according to the present invention may include couplers represented by Formulas C-I and C-II disclosed in Japanese Patent O.P.I. Publication No. 114154/1992, page 5, left lower column. Specific compounds may include those disclosed as CC-1 to CC-9 in the same publication, page 5, right lower column to page 6, left lower column.

Magenta couplers preferably usable in the light-sensitive silver halide photographic material according to the present invention may include couplers represented by Formulas M-I and M-II disclosed in Japanese Patent O.P.I. Publication No. 114154/1992, page 4, right upper column. Specific compounds may include those disclosed as MC-1 to MC-11 in the same publication, page 4, left lower column to page 5, right upper column. In particular, MC-8 to MC- 11 disclosed in the same publication, page 5, upper columns, are preferred since they can well reproduce colors ranging from blue, violet to red and also can achieve superior detail representation.

Yellow couplers preferably usable in the light-sensitive silver halide photographic material according to the present invention may include couplers represented by Formula Y-I disclosed in Japanese Patent O.P.I. Publication No. 1 14154/1992, page 3, right upper column. Specific compounds may include those disclosed as YC-1 to YC-9 in the same publication, page 3, left lower column ff. In particular, YC-8 and YC-9 disclosed in the same publication, page 4, left upper column, are preferred since they can reproduce yellow with a desirable color tone.

When the O/W type emulsion dispersion process is used to add the coupler used in the light-sensitive silver halide photographic material according to the present invention, the coupler is usually dissolved in a water-insoluble high-boiling organic solvent with a boiling point of 150° C. or above optionally together with a low-boiling and/or water-soluble organic solvent and emulsifyingly dispersed in a hydrophilic binder such as an aqueous gelatin solution by the use of a surface active agent. As a dispersion means, it is possible to use a stirrer, a homogenizer, a colloid mill, a flow jet mixer, an ultrasonic dispersion machine or the like. After dispersion, or at the same time with the dispersion, the step of removing the low-boiling organic solvent may be inserted. As the high-boiling organic solvent that can be used to dissolve the coupler to effect dispersion, phthalates such as dioctyl phthalate or phosphates such as tricresyl phosphate may preferably be used.

In place of the method in which the high-boiling organic solvent is used, it is also possible to use a method in which the coupler and a polymer compound insoluble in water and soluble in organic solvent are optionally dissolved in a low-boiling and/or a water-soluble organic solvent and emulsifyingly dispersed by means of a dispersion means of various types in a hydrophilic binder such as an aqueous gelatin solution by the use of a surface active agent. The polymer compound insoluble in water and soluble in organic solvent, used here, may include poly(N-t-butyl acrylamide).

For the purpose of shifting absorption wavelength of color forming dyes, compound d-11 disclosed in Japanese Patent O.P.I. Publication No. 114154/1992, page 9, left lower column, and compound A'-1 disclosed in the same publication, page 10, left upper column, can be used. Besides, it is possible to use fluorescent dye releasing compounds disclosed in U.S. Pat. No. 4,774,187.

In the light-sensitive silver halide photographic material according to the present invention, it is advantageous to use gelatin as a binder. Other gelatin, gelatin derivatives, graft polymers of gelatin with other macromolecules, and hydrophilic colloids such as proteins other than gelatin, sugar derivatives, cellulose derivatives, and hydrophilic colloids of synthetic hydrophilic polymeric substances such as homo- or copolymers may also be optionally used.

In the light-sensitive silver halide photographic material according to the present invention, the support surface may be optionally subjected to corona discharging, ultraviolet irradiation, flame treatment or the like and thereafter silver halide emulsions may be coated thereon directly or via a under coat layer (one or more under coat layers for improving support surface adhesion, antistatic properties, dimensional stability, abrasion resistance, hardness, anti-halation properties, frictional properties and/or other properties).

When the light-sensitive material is prepared by coating silver halide emulsions, a thickening agent may be used in order to improve coating performance. As coating processes, extrusion coating and curtain coating are particularly useful, which can perform simultaneous coating of two or more layers.

In the light-sensitive silver halide photographic material according to the present invention, a hardening agent of various types is used so that coating layers can be prevented from being damaged or dissolved during processing. As the hardening agent, a number of compounds are known in the art, including epoxy compounds, aziridine compounds, acryloyl compounds, vinylsulfonyl compounds and chlorotriazine compounds. Any known hardening agents can be preferably used in the light-sensitive silver halide photographic material according to the present invention.

To form photographic images by the use of the light-sensitive silver halide photographic material according to the present invention, it is common to print images optically formed on printing light-sensitive silver halide photographic materials from negative images recorded on negative films. It is also possible to print images formed on printing light-sensitive silver halide photographic materials from images first converted into digital information and then formed on a CRT (cathode ray tube), or to print such images by scanning while changing the intensity of laser light in accordance with the digital information.

In the case when the light-sensitive material is exposed using a laser, there are no particular limitations on exposure time per picture element. In many instances, exposure is carried out in 100 nanoseconds to 100 microseconds. Exposure carried out in a very short time may often cause the phenomenon that the slope of the characteristic curve greatly changes at a certain turning point density. Once any density variation occurs on account of variations in conditions such as temperature and time for the exposure, images may have false contours at some density regions, resulting in a great lowering of image quality. The light-sensitive silver halide photographic material according to the present invention can be advantageously used also against characteristics under exposure for 100 microseconds or shorter.

The exposure time per picture element is meant as follows: The part at which light intensity comes to be ½ of a maximum value in spatial changes of intensity of the luminous flux of the light is regarded as an outer edge of luminous flux, and the distance between two points at which a line parallel to a scanning line and passing a point at which the light intensity becomes maximum intersects the outer edge of the luminous flux is regarded as a diameter of luminous flux, where the exposure time per picture element is regarded as:

(diameter of luminous flux)/(scanning speed).

Laser printers that can be considered applicable to such a system may include, for example, those disclosed in Japanese Patent O.P.I. Publications No. 4071/1980, No. 11062/1984, No. 197947/1988, No. 74942/1990 and No. 236538/1990, Japanese Patent Examined Publications No. 14963/1981 and No. 40822/1981, European Patent No. 77410, DENSHI TSUSHIN GAKKAI GIJUTSU KENKYU HOKOKU (Electronic Communication Society, Technical Research Reports), Vol. 80, No. 244, and EIGA TEREBI GIJUTUSHI (Movies & Television Engineering) 1984/6(382), pages 34–36.

As light sources used to expose the light-sensitive silver halide photographic material according to the present invention, gas lasers or semiconductor lasers such as a helium-cadmium laser (about 442 nm), a helium-neon laser (about 544 nm) and a helium-neon laser (about 633 nm) are preferably used as a blue light source, a green light source and a red light source, respectively. As for the semiconductor lasers, any lasers may be used so long as they have an intensity high enough for the desired wavelengths, and may include a gallium-arsenic-phosphorus laser, an aluminum-gallium-arsenic laser, an indium-gallium-arsenic-phosphorus laser and an aluminum-gallium-arsenic-antimony laser. In particular, semiconductor lasers of 670, 750, 780, 810, 830 and 880 nm are advantageously used in view of light intensity and handling of light-sensitive silver halide photographic materials.

As aromatic primary amine developing agents used in the present invention, any known compounds may be used. Such compounds can be exemplified by the following compounds.

CD-1) N,N-diethyl-p-phenylenediamine

CD-2) 2-Amino-5-diethylaminotoluene

CD-3) 2-Amino-5-(N-ethyl-N-laurylamino)toluene

CD-4) 4-Amino-3-methyl-N-ethyl-N-(β-butoxyethyl)aniline

CD-5) 2-Methyl-4-[N-ethyl-N-(β-hydroxyethyl)amino] aniline

CD-6) 4-Amino-3-methyl-N-ethyl-N-[β-methanesulfonamido)ethyl] aniline

CD-7) N-(2-Amino-5-diethylaminophenylethyl-)methanesulfonamide CD-S) N,N-dimethyl-p-phenylenediamine CD-9) 4-Amino-3-methyl-N-ethyl-N-methoxyethylaniline CD-10) 4-Amino-3-methyl-N-ethyl-N-(β-ethoxyethyl)aniline CD-11) 4-Amino-3-methyl-N-ethyl-N-(β-butoxyethyl)aniline In addition to the above color developing agent, known developing solution component compounds may be added to color developing solutions. Alkali agents having a pH buffer action, chloride ions, development restrainers such as benzotriazole, preservatives and chelating agents are usually used.

In the case when the light-sensitive silver halide photographic material according to the present invention is a light-sensitive color photographic material, it is subjected to bleaching and fixing after color developing. The bleaching may be carried out at the same time with fixing. After the fixing, water washing is usually carried out. In place of the water washing, stabilizing may be carried out.

In the case when running processing is carried out while continuously replenishing a color developing solution, and in order to produce no overflow solution from the color developing solution so that the problem of environmental pollution caused by waste liquor can be decreased, the color developing solution may preferably be replenished in an amount of from 20 to 60 ml per 1 $m^2$ of the light-sensitive material. The light-sensitive silver halide photographic material according to the present invention can be preferably used also under such conditions.

As photographic processing apparatus used to photographically process the light-sensitive silver halide photographic material according to the present invention, the apparatus may be of a roller transport type in which light-sensitive materials are held between, and transported through, rollers provided in processing tanks, or an endless belt system in which light-sensitive materials are secured to, and transported on, a belt. It is also possible to use a system in which processing tanks are formed in the form of slits, where processing solutions are fed to such processing tanks and at the same time light-sensitive materials are transported therethrough, a system in which processing solutions are sprayed, a web system in which light-sensitive materials are brought into contact with carriers impregnated with processing solutions, and a system in which viscous processing solutions are used.

EXAMPLES

The present invention will be described below in greater details by giving Examples. Embodiments of the present invention are by no means limited to these.

Example 1

High-density polyethylene was coated on both sides of a base paper having a basis weight of 180 g/$m^2$, to produce a paper support. On its side on which emulsion layers were to be provided, molten polyethylene containing surface-treated anatase type titanium oxide in a dispersed state in an amount of 15% by weight was also coated, followed by smoothing using a smooth cooling roller to produce a reflective support having a smooth surface. On the reflective support thus obtained, layers constituted as shown below were provided by coating. Thus, a light-sensitive silver halide photographic material, Sample 101, was produced. Coating solutions were prepared in the following way.

First-layer coating solution:

To 23.4 g of yellow coupler Y-1, 3.34 g of dye image stabilizer ST-1, 3.34 g of dye image stabilizer ST-2, 3.34 g of dye image stabilizer ST-5, 0.33 g of antistain agent HQ-1, 5.0 g of compound A and 5.0 g of high-boiling organic solvent DBP, 60 ml of ethyl acetate was added to carry out dissolution. The solution thus prepared was emulsifyingly dispersed in 220 ml of an aqueous 10% gelatin solution containing 7 ml of 20% surface active agent SU-1, by means of an ultrasonic homogenizer to produce a yellow coupler dispersion. This dispersion was mixed with blue-sensitive silver halide emulsion Em-B shown below. Thus, a first-layer coating solution was prepared.

Second-layer to seventh-layer coating solutions were also prepared in the same manner as the first-layer coating solution so as to provide coating weights as shown in Tables 1 and 2.

As hardening agents, H-1 and H-2 were also added. As coating aids, surface active agents SU-2 and SU-3 were added to control surface tension. F-1 was further added to each layer so as to be in a total weight of 0.04 g/m$^2$. T,420 T,440

The amount of each silver halide emulsion added is indicated in terms of silver. T,460

SU-1: Sodium tri-isopropylnaphthalenesulfonate

SU-2: Sulfosuccinic acid di(2-ethylhexyl).sodium salt

SU-3: Sulfosuccinic acid di(2,2,3,3,4,4,5,5-octafluoropentyl)·sodium salt

DBP: Dibutyl phthalate

DNP: Dinonyl phthalate

DOP: Di(2-ethylhexy) phthalate

DIDP: Diisodecyl phthalate

PVD: Polyvinyl pyrrolidone

H-1: Tetrakis(vinylsulfonylmethyl)methane

H-2: 2,4-Dichloro-6-hydroxy-s-triazine.sodium salt

Compound A: p-(t-Octyl) phenol

Preparation of blue-sensitive silver halide emulsion:

In 1 liter of an aqueous 2% gelatin solution kept at a temperature of 40° C., the following solution A and solution B were simultaneously added over a period of 30 minutes while controlling the pAg and pH to be 7.3 and 3.0, respectively, and the following solution C and solution D were further simultaneously added over a period of 180 minutes while controlling the pAg and pH to be 8.0 and 5.5, respectively. At this time, the pAg was controlled by the method disclosed in Japanese Patent O.P.I. Publication No. 45437/1984 and the pH was controlled using an aqueous solution of sulfuric acid or sodium hydroxide. T,520

After completion of the addition, the emulsion was desalted using an aqueous 5% solution of DEMOL-N, produced by Kao Atlas Co, and an aqueous 20% solution of magnesium sulfate, and then mixed with an aqueous gelatin solution to obtain a monodisperse cubic emulsion EMP-1 having an average grain size of 0.85 μm, a coefficient of variation (S/R) of 0.07 and a silver chloride content of 99.5 mol%.

Next, the emulsion EMP-1 was subjected to chemical sensitization to an optimum at 60° C using the following compounds to obtain a blue-sensitive silver halide emulsion Em-B. T,530

Preparation of green-sensitive silver halide emulsion:

The preparation of EMP-1 was repeated except that the addition time of the solutions A and B and the addition time of the solutions C and D were changed, to obtain a monodisperse cubic emulsion EMP-2 having an average grain size of 0.43 μm, a coefficient of variation (S/R) of 0.08 and a silver chloride content of 99.5 mol%.

The emulsion EMP-2 was also subjected to chemical sensitization to an optimum at 55° C. using the following compounds to obtain a green-sensitive silver halide emulsion Em-G. T,531

Preparation of red-sensitive silver halide emulsion:

The preparation of EMP-1 was repeated except that the addition time of the solutions A and B and the addition time of the solutions C and D were changed, to obtain a monodisperse cubic emulsion EMP-3 having an average grain size of 0.50 μm, a coefficient of variation (S/R) of 0.08 and a silver chloride content of 99.5 mol%.

The emulsion EMP-3 was also subjected to chemical sensitization to an optimum at 60° C. using the following compounds to obtain a red-sensitive silver halide emulsion Em-R. T,540 T,550

STAB-1: 1-(3-Acetamidophenyl)-5-mercaptotetrazole

STAB-2: 1-Phenyl-5-mercaptotetrazole

STAB-3: 1-(4-Ethoxyphenyl)-5-mercaptotetrazole

In the preparation of the support used in Sample 101, the cooling roll was replaced with a roll engraved with various patterns, to produce a reflective support having various irregularities on its surface. The preparation of Sample 101 was repeated to produce Samples 102 to 104, except that the reflective support was replaced with the above support having various irregularities on its surface. The preparation of Samples 101 to 104 were also repeated to produce Samples 105 to 108, except that S-1 layer and S-2 layer as shown in Table 3 below were provided between the support and the first layer. T,560

Next, with regard to these Samples 101 to 108, densities were measured by means of KONICA MICRODENSITOMETER PDM5-TYPE using an aperture of 10 μm× 400 μm. As a result, it was found that the presence of the white pigment layer did not so greatly affect the WS but tended to increase the WS intensity to a certain extent.

Using the light-sensitive silver halide photographic materials Samples 101 to 108, color prints were produced using color negatives of the following four scenes having been photographed.

Scene 1: A portrait of a woman wearing a red sweater.

Scene 2: A group portrait.

Scene 3: A mountainscape (a natural landscape)

Scene 4: A landscape of an amusement park (an artificial landscape)

Photographic processing conditions used to produce the color prints are as shown below. T,580

Tank solutions and replenishing solutions of processing solutions each had the composition as shown below. T,581

Made up to 1 liter in total by adding water, and the tank solution was adjusted to pH 10.10 and the replenishing solution to pH 10.60. T,590

Made up to 1 liter in total by adding water, and adjusted to pH 5.7 using potassium carbonate or glacial acetic acid. T,591

Made up to 1 liter in total by adding water, and adjusted to pH 7.5 using sulfuric acid or ammonia water.

Color prints thus produced were presented to ten panelists to have them evaluate visual sharpness and detail representation. Evaluation was made according to five rank system of "very good (5 points)", "good (4 points)", "ordinary (3 points)", "a little poor (2 points)" and "poor (1 point)", and an average value was found for them on each print.

Results obtained are shown in Table 4 below. T,610

Samples 101 and 105 have almost smooth surfaces, and hence the ratios of WS intensities do not so change in the two regions of 2 to 3 mm$^{-1}$ and 10 to 20 mm$^{-1}$. Samples 102, 104, 106 and 108 have surfaces where substantially similar amorphous patterns are distributed at random, and show high WS intensities at 10 to 20 mm$^{-1}$. Samples 103 and 107 have surfaces where a little large, substantially amorphous patterns are emphasized by making the irregular surface have a large peak-to-valley distance, and hence show high WS intensities at a spatial frequency of 2 to 3 $mm^{-1}$ and lower intensities than that at a spatial frequency of 10 to 20 $mm^{-1}$.

Sample 101, having substantially a smooth surface, is high evaluated in respect of the naturalness of detail representation in all scenes, but a little low evaluated in respect of the sharpness. As a matter not especially evaluated at this time, this sample had also the disadvantages that the light from the light source was reflected in the print because of a strong gloss and the rather large surface irregularities of the base paper were felt unusual. Sample 105, comprising this base paper but provided with the white pigment layer, is rather high evaluated in respect of the sharpness but not so high beyond expectation, and there is seen a phenomenon that the naturalness of detail representation becomes lower. The reason therefor is still unclear or has not been made clear, and is presumed that, although the detail representation has been improved because of an increase in physical sharpness, such a high physical sharpness has instead emphasized the noise of images, resulting in an unnaturalness and a low evaluation in respect of the visual sharpness.

Sample 103, having the surface with a little large, amorphous patterns, is low evaluated in respect of the sharpness of images, in particular, low evaluated in the scenes of B. Sample 107, provided with the white pigment layer, shows a little improvement in the sharpness, but is low evaluated in respect of the naturalness.

Meanwhile, although light-sensitive silver halide photographic materials Samples 102 and 104 are a little low evaluated in respect of the naturalness of detail representation and also low evaluated in respect of the sharpness as compared with Sample 101, they are seen to have been improved in both the naturalness of detail representation and the sharpness because of the use of the white pigment layer. Presumably, the improvement in physical sharpness has brought about an improvement in detail representation, so that they are evaluated as being improved in the naturalness. In particular, the reason why Sample 108 is high evaluated is that the slope of WS at spatial frequency of 2 to 3 $mm^{-1}$ shows a proper value, and is seen to have been improved particularly in the naturalness of detail representation.

Example 2

In the preparation of the paper support used in Samples 106 and 108 in Example 1, various types of base paper obtained by changing paper making conditions were used or the manner of embossing polyethylene was changed to produce reflective supports, and the hydrophilic colloid layer and the silver halide photographic emulsion layers were provided thereon by coating. Thus, light-sensitive silver halide photographic materials were produced. Here, the speed for coating the silver halide photographic emulsion layers was changed to produce light-sensitive silver halide photographic material having various WS. Using samples thus obtained, evaluation was made in the same manner as in Example 1.

Results obtained are shown in Table 5 below. T,640

Like Example 1, it is seen that the light-sensitive silver halide photographic material according to the present invention can achieve improvements in the visual sharpness and the naturalness of detail representation. It has been also made clear that a too large value of WS2/WA1 causes a lowering of the sharpness and the slope of WS at spatial frequency of 2 to 3 $mm^{-1}$ is effective for the improvement in naturalness.

Example 3

Using the samples as used in Example 1, color prints were produced in the same manner as in Example 1 except that the photographic processing was carried out according to the following processing steps. The processing steps and the composition of each processing solution were as follows: T,660

Tank solutions and replenishing solutions of processing solutions each had the composition as shown below. T,661
Made up to 1 liter in total by adding water, and the tank solution was adjusted to pH 10.10 and the replenishing solution to pH 10.60. T,670
Made up to 1 liter in total by adding water, and the tank solution was adjusted to pH 7.0 and the replenishing solution to pH 6.5 using potassium carbonate or glacial acetic acid. T,671
Made up to 1 liter in total by adding water, and adjusted to pH 7.5 using sulfuric acid or ammonia water.

Using color prints thus produced, evaluation was made in the same manner as in Example 1.

Results obtained are shown in Table 6 below. T,690

Although the evaluation values are a little low on the whole because of the change of processing time, it has been ascertained that the effect of the present invention is still obtained.

Example 4

The preparation of the light-sensitive silver halide photographic materials Samples 105 to 108 in Example 1 was repeated to produce light-sensitive silver halide photographic materials Samples 401 to 412, except that black colloidal silver and/or hollow microcapsules comprised of a styrene-acrylic acid copolymer were added to the white pigment layer.

Contents of the samples are shown in Table 7 below. T,710

On the above samples, evaluation was made in the same manner as in Example 1.

Results obtained are shown in Table 8 below. T,730

The samples in which the black colloidal silver has been added show an increase in sharpness also in respect of the visual sharpness, but the comparative samples show the results that the unnaturalness of detail representation is emphasized. Among the samples in which the styrene-acrylic acid copolymer has been added, its addition is only a little contributory to the improvement in sharpness in the case of comparative examples, but in the case of the light-sensitive silver halide photographic materials according to the present invention the detail representation was seen to be improved especially at highlight portions and also superior images were found to be obtainable. These are preferred embodiments of the light-sensitive silver halide photographic material according to the present invention.

Example 5

Using Samples 101 to 108 of Example 1, color prints were produced by laser exposure. Image data used were those obtained from images of color slides with a size of 4×5 inches, digitized in a size of 25×25 μm per picture element by means of a scanner.

As an exposure apparatus, a helium-cadmium laser (about 442 nm), a helium-neon laser (about 544 nm) and a helium-neon laser (about 633 nm) were made ready for use as a blue light source, a green light source and a red light source, respectively, to set up an optical system. The light rays emitted from the three lasers were modulated in accordance with the image data, and thereafter converged into a single beam, where light-sensitive silver halide photographic materials each transported at a speed of 20 mm/second were subjected to scanning exposure at a primary scanning speed of 160 m/second at right angles in the direction of transport. The beam diameter at this time was about 50 μm, and the exposure time per picture element was 300 nanoseconds.

With regard to the color prints thus obtained, evaluation was made in the same manner as in Example 1 to obtain the results as shown in Table 9 below. T,760

Even by laser exposure, color prints having the same good color reproduction as usual color prints were obtainable from the light-sensitive silver halide photographic material according to the present invention, Samples 106 and 108. However, only images unsatisfactory in both the sharpness and the detail representation were obtainable from Samples 105 and 107. In this instance, images having a better visual quality were rather obtainable by processing on a soft wear, from light-sensitive silver halide photographic materials having no white pigment layer.

Next, image output was adjusted so as to output images in the form of dots of about 50×50 μm, and then images were outputted. As a result, the color prints produced from the light-sensitive silver halide photographic material according to the present invention, Samples 106 and 108, impressed the panelists as being closer to prints produced using ink than the images obtained using the comparative samples 102 and 104. The light-sensitive silver halide photographic material according to the present invention can be also used for color proof.

Next, light-sensitive silver halide photographic material with infrared-sensitivity were produced, and evaluation was made similarly.

Preparation of infrared-sensitive silver halide emulsions Em-IR1 and -IR2:

The preparation of the blue-sensitive emulsion Em-B of Example 1 was repeated to prepare an infrared-sensitive silver halide emulsion Em-IR1, except that the spectral sensitizing dye was replaced with IRS-1, and also the preparation of the green-sensitive emulsion Em-G was repeated to prepare an infrared-sensitive silver halide emulsions Em-IR2, except that the spectral sensitizing dye was replaced with IRS-2.

The preparation of Samples 101 to 108 of Example 1 was repeated to produce Samples 501 to 508, except that the blue-sensitive silver halide emulsion was replaced with the infrared-sensitive silver halide emulsion Em-IR1, the green-sensitive silver halide emulsion was replaced with the infrared-sensitive silver halide emulsion Em-IR2, and also the anti-irradiation dyes AI-3 and AI-1 were replaced with AI-4 and AI-5, respectively. T,790

As an apparatus for exposing light-sensitive materials, an aluminum-gallium-indium-phosphorus semiconductor laser (about 670 nm), a gallium-aluminum-arsenic semiconductor laser (about 780 nm) and a gallium-aluminum-arsenic semiconductor laser (about 830 nm) were made ready for use to set up an optical system. The diameter of light beams, the transport speed and so forth were set under the same conditions as those of the laser printer previously described. Using this apparatus, images were outputted to the above Samples 501 to 508. As a result, it was possible on Samples 506 and 508 to obtain color prints having a superior image quality. Evaluation was made in the same manner as in Example 1 to obtain the results as shown in Table 10 below. T,810

In the light-sensitive silver halide photographic materials according to the present invention, it has been ascertained that the present invention can be effective also when the silver halide photographic emulsion layer with infrared-sensitivity is used.

As described above, the present invention can provide the light-sensitive silver halide photographic material that can obtain a photographic print having a moderate glossiness and having superior detail representation and visual sharpness of images.

What is claimed is:

1. A light-sensitive silver halide photographic material comprising a reflective support comprising a resin layer-coated base paper and having thereon a silver halide emulsion layer, wherein a hydrophilic colloid layer containing a white pigment is provided between the resin layer and the silver halide emulsion layer; the resin layer having an uneven surface; and a Wiener spectrum of the silver halide photographic material satisfying the following relation, $$1.1 < (WS2) / (WS1) < 2.0$$

wherein WS1 and WS2 are average intensities of the spectrum within a spatial frequency range of 2 to 3 $mm^{-1}$ and 10 to 20 $mm^{-1}$, respectively.

2. The photographic material of claim 1, wherein said uneven surface has a peak-to-valley distance of 0.1 to 30 μm.

3. The photographic material of claim 1, wherein said wiener spectrum of the photographic material has an average gradient of 0.8 to 2.2 within a spatial frequency range of 2 to 3 $mm^{-1}$.

4. The photographic material of claim 1, wherein said hydrophilic colloid layer contains a white pigment selected from rutile type titanium dioxide, anatase type titanium dioxide, barium sulfate, barium stearate, silica, alumina, zirconium oxide and caolin.

5. The photographic material of claim 4, wherein said white pigment is contained in an amount of 1 to 50 $g/m^2$.

6. The photographic material of claim 1, wherein said hydrophilic colloid layer contains a colorant, filter dye or microcapsule.

7. The photographic material of claim 1, wherein said silver halide emulsion layer contains silver halide grains having a chloride content of 95 mol% or more.

* * * * *